US008833234B2

(12) United States Patent
Gronau et al.

(10) Patent No.: US 8,833,234 B2
(45) Date of Patent: Sep. 16, 2014

(54) CYLINDER

(75) Inventors: Jens-Thorsten Gronau, Hameln (DE); Mike Heurich, Apelern (DE); Christian Seestädt, Hannover (DE); Tino Wiggers, Seelze (DE)

(73) Assignee: WABCO GmbH, Hannover (DE)

( * ) Notice: Subject to any disclaimer, the term of this patent is extended or adjusted under 35 U.S.C. 154(b) by 966 days.

(21) Appl. No.: 12/736,017

(22) PCT Filed: Feb. 4, 2009

(86) PCT No.: PCT/EP2009/000731

§ 371 (c)(1),
(2), (4) Date: Nov. 3, 2010

(87) PCT Pub. No.: WO2009/115168

PCT Pub. Date: Sep. 24, 2009

(65) Prior Publication Data

US 2011/0048363 A1 Mar. 3, 2011

(30) Foreign Application Priority Data

Mar. 15, 2008 (DE) ..... 10 2008 014 506

(51) Int. Cl.
*F15B 15/20* (2006.01)
*F15B 15/28* (2006.01)
*F15B 15/14* (2006.01)

(52) U.S. Cl.
CPC ..... *F15B 15/2815* (2013.01); *F15B 15/1447* (2013.01)
USPC ..... 92/5 R; 92/165 PR; 91/1

(58) Field of Classification Search
CPC ..... F15B 15/1447; F15B 15/2815
USPC ..... 92/5 R, 165 R, 165 PR; 91/1
See application file for complete search history.

(56) References Cited

U.S. PATENT DOCUMENTS

| | | | | |
|---|---|---|---|---|
| 5,518,305 | A * | 5/1996 | Jakobi et al. | 303/114.3 |
| 6,102,829 | A * | 8/2000 | Muddell et al. | 477/77 |
| 7,650,828 | B2 | 1/2010 | Rau et al. | |
| 2003/0172651 | A1 * | 9/2003 | Zehnder et al. | 60/534 |

FOREIGN PATENT DOCUMENTS

| | | | |
|---|---|---|---|
| DE | 102 55 396 | A1 | 6/2004 |
| DE | 20 2005 005 508 | U1 | 7/2005 |
| DE | 20 2007 001 020 | U1 | 9/2007 |
| EP | 0 829 407 | A2 | 3/1998 |

* cited by examiner

*Primary Examiner* — Ned Landrum
*Assistant Examiner* — Logan Kraft
(74) *Attorney, Agent, or Firm* — Kramer Levin Naftalis & Frankel LLP

(57) ABSTRACT

A cylinder includes a piston moving in a cylinder housing fastened to a cylinder rod and rotatable about a cylinder longitudinal axis, and a position sensor comprising a sensor magnet and a sensor element, which interacts with the sensor magnet and which is configured to detect a cylinder rod position relative to the cylinder housing. The sensor magnet is fastened on the cylinder rod rotatably with respect to the cylinder rod and is guided non-rotatably with respect to the cylinder housing.

16 Claims, 4 Drawing Sheets

CYLINDER

FIELD OF THE INVENTION

The present invention generally relates to embodiments of a cylinder having a piston that runs in a cylinder housing, is fastened to a cylinder rod and can be rotated about a cylinder axis, and a position sensor that comprises a sensor magnet and a sensor element that interacts with the sensor magnet, the sensor magnet being configured to detect a cylinder-rod position relative to the cylinder housing.

BACKGROUND OF THE INVENTION

A piston of the general type under consideration is described in DE 20 2005 005 508 U1, in which part magnets, which complement one another to form a magnetic ring, are arranged on the piston. The magnetic field of the part magnets is detected by a magnetic field sensor. A disadvantage of this piston is its high production cost.

DE 20 2007 001 020 U1 describes a fluidic cylinder having a position detection device for the piston position. This construction is also disadvantageous in that the cylinder is complicated to produce and difficult to maintain.

SUMMARY OF THE INVENTION

Generally speaking, it is an object of the present invention to provide a cylinder that is easy to produce, simple to maintain and that influences surrounding sensors to a less pronounced extent.

In accordance with embodiments of the present invention, this is achievable by means of a cylinder in which the sensor magnet is fastened to the cylinder rod such that it can be rotated with regard to the cylinder rod, and is guided in a rotationally fixed manner with regard to the cylinder housing.

It is advantageous here that a cylinder of this type is simple to produce. For instance, a standard cylinder can be used, to which only the special position sensor has to be fastened. It is a further advantage that the position sensor does not require any additional installation space at all in the circumferential direction, with the result that the cylinder is of narrow design in the circumferential direction.

It is a further advantage that a very small magnet can be used, which reduces the production costs. At the same time, leakage fields are reduced considerably, as a result of which surrounding sensors are influenced to a lesser extent.

In the context of the present description, a cylinder rod is understood as meaning, in particular, every component that is coupled fixedly to the piston with regard to the actuating direction of the piston. For instance, the cylinder rod can comprise a plurality of part cylinder rods that are fastened to one another in a push-stable manner or by joints. The feature that an object is arranged in a rotationally fixed manner with regard to another object is to be understood, in particular, as meaning that free rotation, for example by several revolutions, is not possible. However, that does not rule out pivoting being possible by a small angular range, for example less than 20°.

According to one preferred embodiment, the sensor magnet extends exclusively over a fraction of a cylinder-rod circumferential angle of the cylinder rod. Since the sensor magnet is guided in a rotationally fixed manner with regard to the cylinder housing, it is merely necessary that the sensor magnet always faces the sensor element. On a side of the cylinder rod which faces away from the sensor element, no magnetic element is necessary and possibly even damaging, since surrounding sensors can be influenced. It is advantageous here that the magnetic element can be produced to be small and therefore inexpensive. It is a further advantage that the magnetic field which surrounds the sensor magnet is present only in the immediate vicinity of the sensor element. As a result, magnetic interference fields are avoided which otherwise can disrupt other sensors which are arranged in the vicinity. It is additionally advantageous that a small sensor magnet is also influenced less by external magnetic fields, which for its part increases the measuring accuracy.

It has proven sufficient and advantageous if the sensor magnet extends over less than a third, in particular less than a fifth, of the cylinder-rod circumferential angle of the cylinder rod. It is even possible that the sensor magnet extends over the cylinder-rod circumferential angle by less than 70° or even less than 45°.

A sensor magnet that is particularly simple to produce is obtained if it is circular segment-shaped. It is particularly advantageous here that a sensor magnet of this type with a given magnetic field strength is of particularly small design radially.

A structurally simple piston is obtained if the sensor magnet is fastened to an adapter, the adapter being free of magnetized material on a side facing away from the sensor element and being fastened to the cylinder rod such that it cannot be displaced in at least one direction with regard to the cylinder-rod longitudinal direction. As a result of the adapter being free of magnetized material on a side facing away from the sensor element, spatially extensive magnetic fields are avoided, which can disrupt magnetic field sensors positioned in the surrounding area. In addition, the cylinder can be produced particularly simply and inexpensively by the omission of magnetized material. The feature that the adapter is fastened to the cylinder rod such that it can be displaced in at least one direction with regard to the cylinder-rod longitudinal direction is to be understood, in particular, as meaning that a movement of the piston in at least one direction always leads to a movement of the adapter in the same direction. In other words, the adapter is driven by the cylinder rod in at least one direction.

The adapter is preferably guided in a guide sleeve in a rotationally secured manner about the cylinder-rod longitudinal direction. This is to be understood, in particular, as meaning that the guide sleeve is at a standstill relative to the cylinder housing, with the result that the adapter cannot perform a rotational movement relative to the cylinder housing. However, a pivoting movement by a few degrees can be possible. To this end, it is not necessary that the cylinder housing and the guide sleeve are connected directly to one another. For instance, it is possible that, for example, the cylinder housing and the guide sleeve are fastened jointly to a third object.

A construction that is particularly simple and relatively insusceptible to disruptions is obtained if the adapter has a guide groove, into which a guide projection of the guide sleeve engages. It goes without saying that it is also possible as an alternative or in addition that the adapter has a guide projection which engages into a recess in the guide sleeve.

The cylinder rod preferably has a stop for the adapter, the piston comprising a spring, ideally a helical spring, which is fastened in a rotationally secured manner relative to the cylinder housing and prestresses the adapter against the stop. Here, the adapter is fastened to the spring in a rotationally secured manner, with the result that the adapter is rotationally secured relative to the cylinder housing. There is provision, for example, for the helical spring to surround the cylinder rod and to be fastened, for example clipped, to the adapter. On the side that lies opposite the adapter, the helical spring is then mounted in a rotationally fixed manner relative to the cylinder housing. The adapter can thus perform small pivoting movements about the cylinder-rod longitudinal axis, but is always pressed back into a rest position by the spring. This construction has the advantage of being particularly simple to produce and to maintain.

The use of the above-described piston is particularly advantageous in a gear actuator for an automatic or semi-automatic gearbox. Here, the cylinder can preferably be configured for shifting a gate of the gearbox. In a gear actuator of this type, neither a gate rod, which serves to shift the gate, nor the cylinder to actuate it may be of rotationally fixed configuration. In known gear actuators, ring magnets are therefore provided, which interact with the sensor element. However, it has been shown that these ring magnets can influence surrounding sensors, for example a gear sensor for determining a gear position of the gearbox or a split sensor for determining a shifting position of a split stage of the gearbox. This problem is avoided by way of a cylinder according to the invention, which can be a pneumatic cylinder or a hydraulic cylinder.

The position sensor is preferably configured as a gate sensor, which detects a position of a gate rod of the gearbox. In this case, the sensor magnet is a gate sensor magnet and the sensor element is a gate sensor element. The sensor elements are preferably magneto-inductive sensor elements, in particular PLCD sensor elements (PLCD=permanent-magnet linear contactless displacement).

Still other objects and advantages of the present invention will in part be obvious and will in part be apparent from the specification.

The present invention accordingly comprises the features of construction, combination of elements and arrangement of parts, all as exemplified in the constructions herein set forth, and the scope of the invention will be indicated in the claims.

BRIEF DESCRIPTION OF THE DRAWINGS

In the following text, exemplary embodiments of the invention will be explained in greater detail with reference to the appended drawings, in which.

DETAILED DESCRIPTION OF THE PREFERRED EMBODIMENTS

Figure 1:
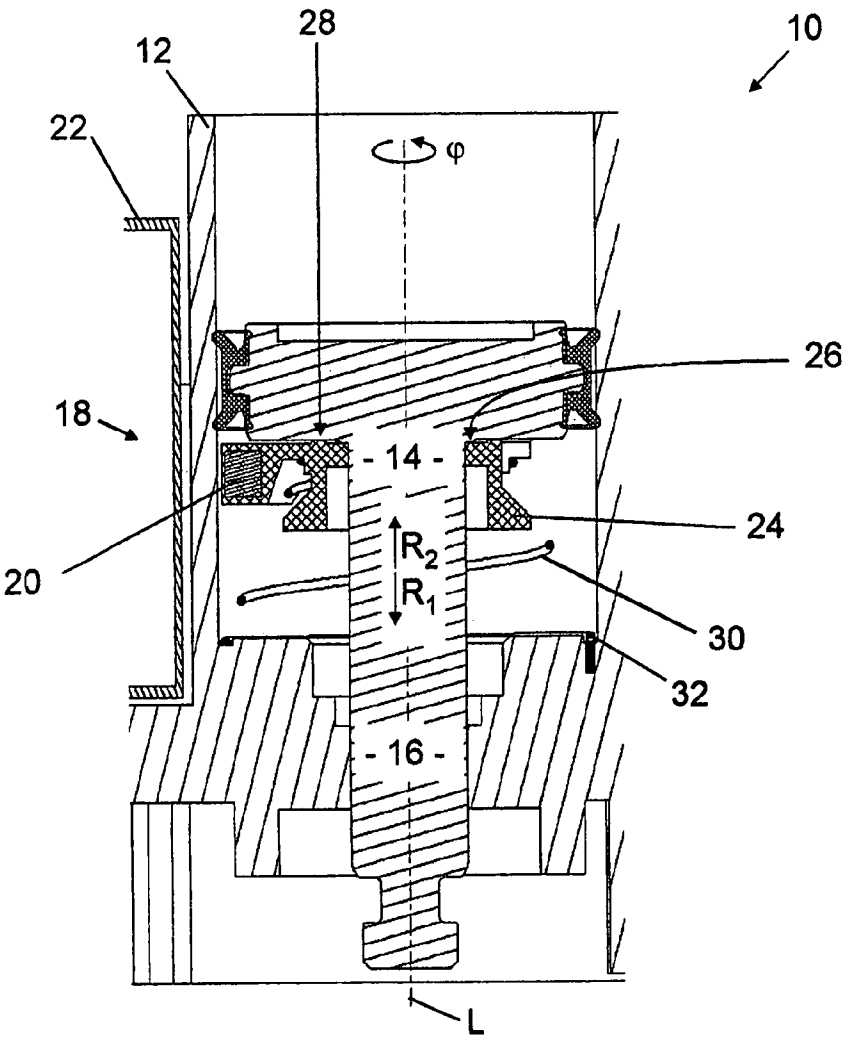
FIG. 1 is a cross section through a cylinder according to an embodiment of the invention.

Referring now to the drawing figures, FIG. 1 shows a cylinder 10 having a piston 14, which runs in a cylinder housing 12, is fastened to a cylinder rod 16 and is fastened such that it can be rotated about a cylinder-rod longitudinal axis L.

In addition, the cylinder 10 comprises a position sensor 18, which comprises a sensor magnet 20 and a sensor element 22 that interacts with the sensor magnet 20. The position sensor 18 is configured such that it measures the position of the piston 14 at a level with respect to the cylinder-rod longitudinal axis L.

The piston 14 can be rotated with regard to the cylinder housing 12 about the longitudinal axis L by a rotary angle cp. The sensor magnet 20 is always arranged opposite the sensor element 22 with regard to the cylinder housing 12 by the said sensor magnet 20 being arranged in a rotationally fixed manner with regard to the cylinder housing 12. To this end, the sensor magnet 20 is fastened to an adapter 24. For example, the sensor magnet 20 is injection-molded, adhesively bonded or clipped into the adapter 24. The piston 14 and the cylinder rod 16 can be rotated relative to the adapter 24. The adapter 24 is mounted on the cylinder rod 16 such that it can be displaced in a first direction $R_1$ along the cylinder-rod longitudinal axis L. To this end, the adapter 24 surrounds the cylinder rod 16 annularly and forms a clearance fit 26 with the cylinder rod 16.

The adapter 24 cannot be moved relative to the piston 14 with regard to a second direction $R_2$ which opposes the first direction $R_1$, since the adapter 24 comes into contact with a stop 28 formed by a surface of the piston 14.

The adapter 24 is a plastic injection-molded part that is non-magnetic and cannot be magnetized, with the result that a permanent magnetic field exists only in a surrounding area of the sensor magnet 20. The sensor element 22 is configured to measure this magnetic field along the cylinder longitudinal axis L in a spatially resolved manner and to determine from this the position of the piston 14. A helical spring 30 is attached, for example clipped, to the adapter 24. As a result, the helical spring 30 is fastened in a rotationally fixed manner to the adapter 24. The helical spring 30 is fastened in a rotationally fixed manner to the cylinder housing 14 in a receiving groove 32 by way of its end that faces away from the adapter 24. As a result, the sensor magnet 20 can pivot about the cylinder longitudinal axis L to the extent of a few degrees, but is always returned to a predefined rotary angle position by the helical spring 30.

Figure 2:
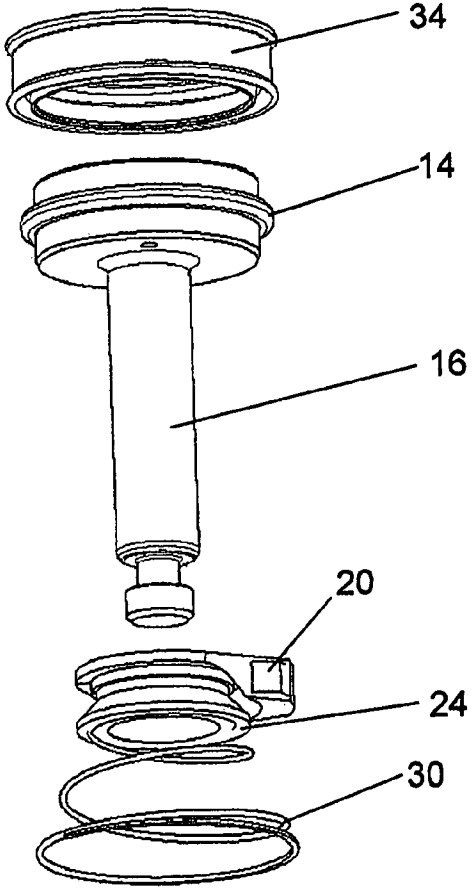
FIG. 2 is an exploded view of the cylinder according to FIG. 1.

FIG. 2 shows an exploded illustration of the components arranged in the cylinder housing 12, it also being possible to see a rubber seal 34 of the piston 14. It can be seen that the sensor magnet 20 extends only by a fraction of a cylinder-rod circumferential angle of the cylinder rod 16. In other words, a multiplicity of sensor magnets 20 could be arranged behind one another in the circumferential direction, until the cylinder rod 16 is surrounded completely radially by sensor magnets 20. The determination of the cylinder-rod circumferential angle will be explained in greater detail below in conjunction with FIG. 4.

Figure 3:
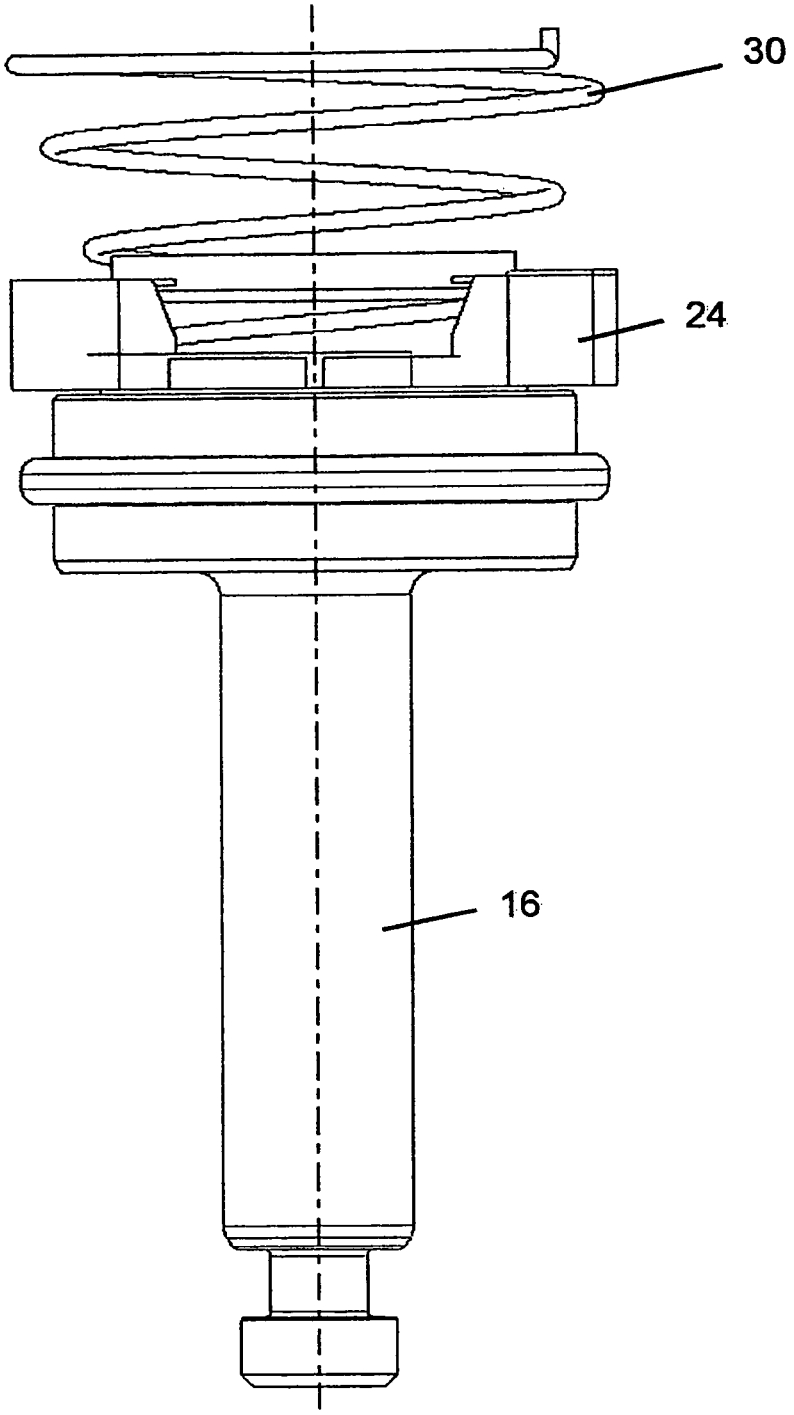
FIG. 3 is a side view of part of the components of a cylinder according to an embodiment of the invention.

FIG. 3 shows the components of a second embodiment of a cylinder according to the invention. In this embodiment, unlike in the embodiment according to FIG. 2, the cylinder rod 16 reaches through neither the adapter 24 nor the helical spring 30. In both embodiments, both according to FIG. 2 and according to FIG. 3, the adapter 24 with the sensor magnet 20 and the helical spring 30 are arranged in the cylinder housing 12. As an alternative, however, it is also possible to arrange the adapter 24 and the helical spring 30 outside the cylinder housing 12.

Figure 4:
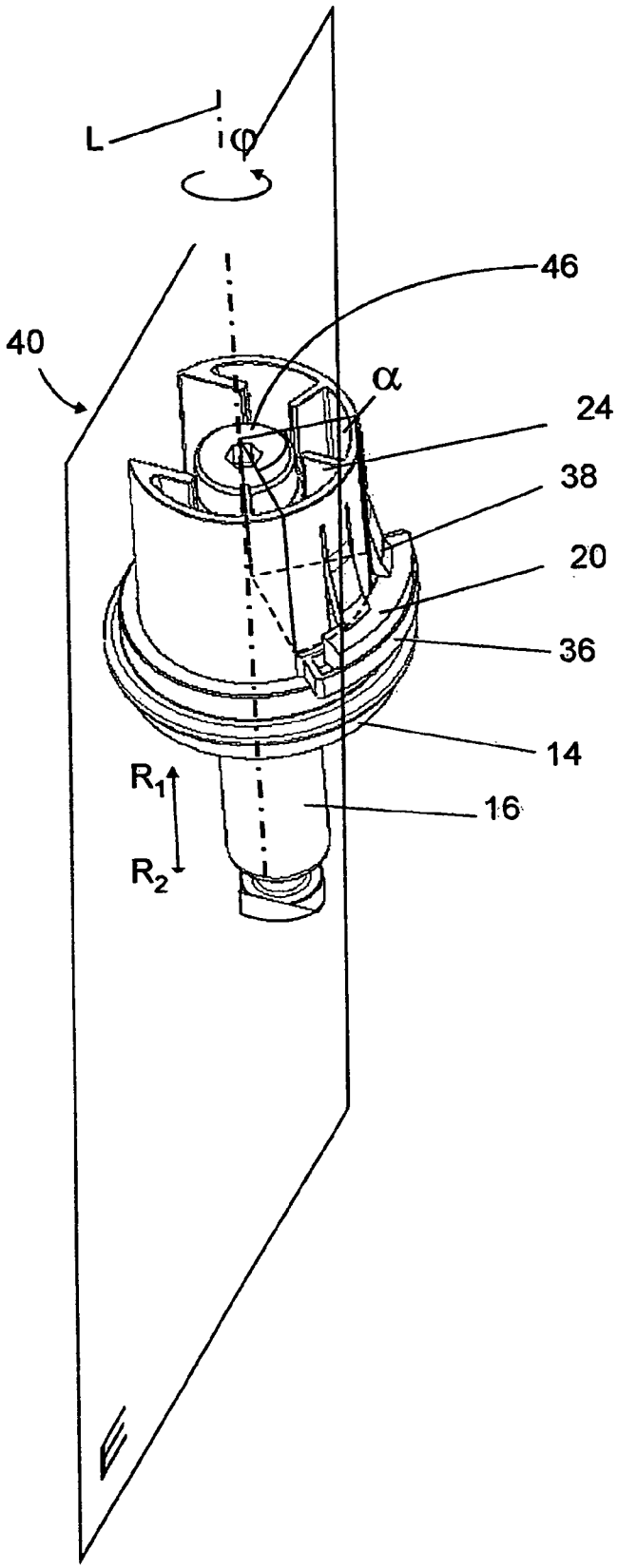
FIG. 4 shows a cylinder as part of a gear actuator in accordance with an embodiment of the invention.

FIG. 4 shows a further embodiment of a cylinder according to the invention, the cylinder housing 12 having been omitted for the sake of clarity. The cylinder rod 16 reaches through the adapter 24, which secures the circular segment-shaped sensor magnet 20. To this end, the adapter 24 has a sensor-magnet receptacle 36 and a clamping projection 38. The sensor magnet 20 is received in the sensor-magnet receptacle 36 and is held fixedly by the clamping projection 38.

The adapter 24 can once again be pivoted freely about the cylinder-rod longitudinal axis L of the cylinder rod 16 by the rotary angle $\phi$. In addition, the sensor magnet 20 extends over a cylinder-rod circumferential angle α. To this end, a measuring plane E is defined, through which the cylinder-rod longitudinal axis L extends. The cylinder-rod circumferential angle α is that angle between two measuring planes E, which just touch the outer sides of the sensor magnet 20. The smaller the cylinder-rod circumferential angle α is, the less any surrounding sensors are influenced negatively by leakage fields. In FIG. 4, a is approximately 90°.

In the embodiment according to FIG. 4, the adapter 24 has a guide groove 40, into which a guide lug 42 (cf. FIG. 5) of a guide sleeve 44 engages.

As FIG. 4 shows, the adapter 24 is connected fixedly to the piston 14 via a screw 46 and thus cannot move relative to the piston 14. The piston 14 can be rotated with respect to the piston rod 16, with the result that the adapter 24 can also be rotated with regard to the cylinder axis. In other words, the cylinder rod 16 can be rotated with regard to the adapter 24 and therefore with regard to the sensor magnet 20.

Figure 5:
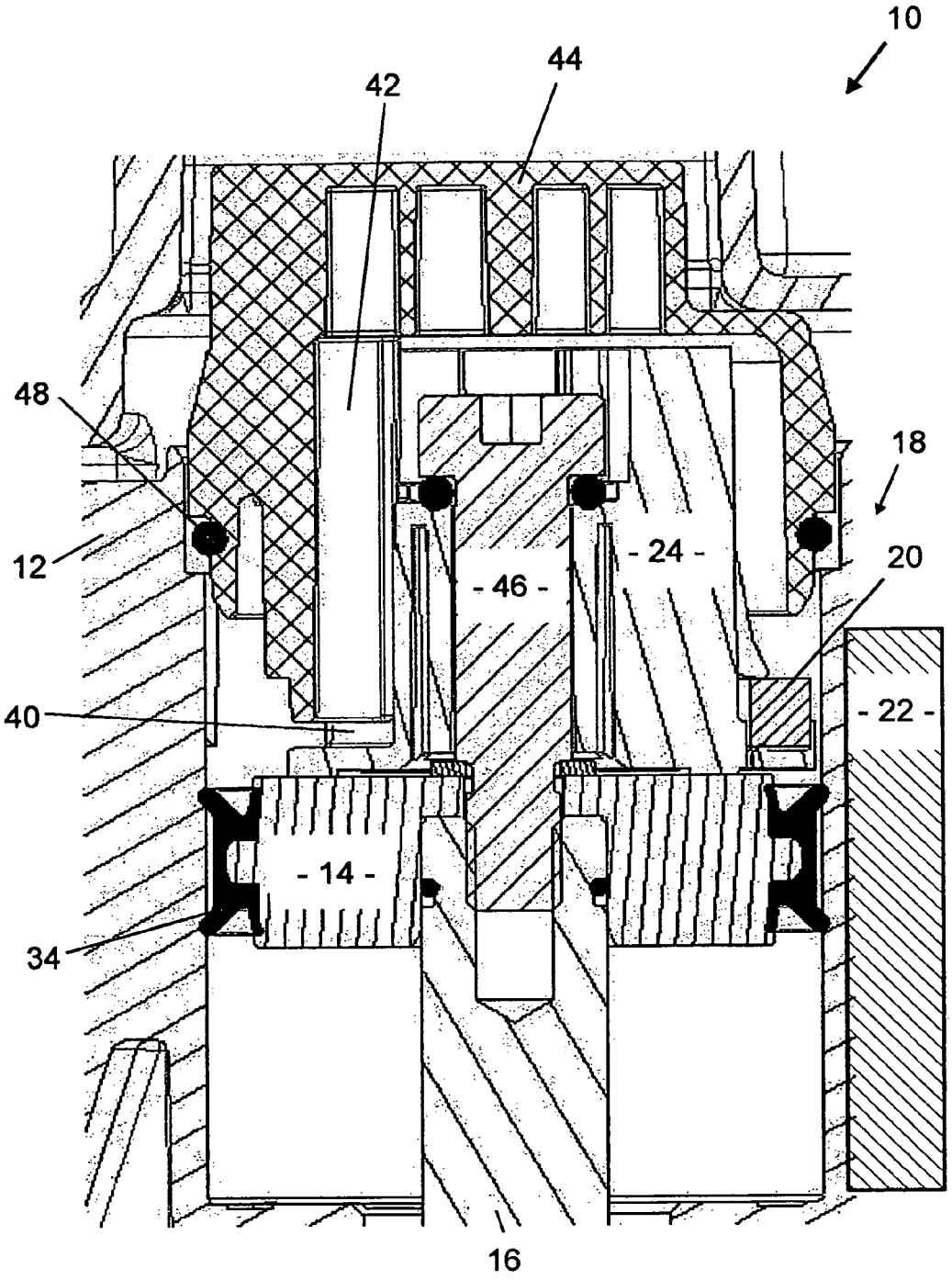
FIG. 5 is a detailed cross-sectional view of the cylinder according to FIG. 4.

FIG. 5 shows a cross section through the cylinder 10, the inner components of which are shown in FIG. 4. It can be seen that the guide sleeve 44 is attached to an end of the cylinder housing 14 and is sealed with respect to the latter by way of an O-ring 48. In FIG. 5, the rubber seal 34 is attached directly to the piston 14. However, it is also conceivable that the rubber seal 34 is attached to the adapter 24. In addition, it is possible that, as in the first embodiment described, the adapter 24 can be turned relative to the piston 14, with the result that the piston can rotate in the cylinder housing 12, without the sensor magnet 20 being removed from its position opposite the sensor element 22. In addition, it is possible that the adapter 24 represents an integral constituent part of the piston 14.

As a result of the guide lug 42 engaging into the guide groove 40 of the adapter 24, the cylinder rod 16 can rotate freely in relation to the cylinder housing, and the sensor magnet is nevertheless guided in a rotationally fixed manner with regard to the cylinder housing 12.

It will be seen that the objects set forth above, among those made apparent from the preceding description, are efficiently attained, and since certain changes may be made without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention that, as a matter of language, might be said to fall therebetween.

What is claimed is:

1. A cylinder comprising:

a piston movable in a cylinder housing, the piston being fastened to a cylinder rod and rotatable about a cylinder-rod longitudinal axis;

a position sensor configured to detect a cylinder-rod position relative to the cylinder housing, the position sensor including a sensor magnet;

a sensor element interactable with the sensor magnet, the sensor magnet being:

fastened to and rotatable with respect to the cylinder rod; and guidable in a rotationally fixed manner with respect to the cylinder housing; and an adapter fastened to the sensor magnet, the adapter being:

free of magnetized material on a side facing away from the sensor element; and fastened to the cylinder rod non-displaceably in at least one direction with respect to the longitudinal direction of the cylinder rod, wherein the adapter is configured to be guided in a guide sleeve in a rotationally secured manner about the cylinder-rod longitudinal axis, and wherein the adapter has a guide groove configured to engage a guide lug of the guide sleeve.

2. The cylinder according to claim 1, wherein the sensor magnet extends exclusively over a portion of a cylinder-rod circumferential angle of the cylinder rod.

3. The cylinder according to claim 2, wherein the sensor magnet extends over less than a third of the cylinder-rod circumferential angle of the cylinder rod.

4. The cylinder according to claim 2, wherein the sensor magnet is circular segment-shaped.

5. The cylinder according to claim 2, wherein the sensor magnet extends over less than one fifth of the cylinder-rod circumferential angle of the cylinder rod.

6. A gear actuator for a gearbox, comprising the cylinder according to claim 1, the cylinder being configured to shift a gate, and the cylinder rod being coupled to a gate rod of the gearbox.

7. A gearbox having the gear actuator according to claim 6.

8. A cylinder comprising:

a piston movable in a cylinder housing, the piston being fastened to a cylinder rod and rotatable about a cylinder-rod longitudinal axis;

a position sensor configured to detect a cylinder-rod position relative to the cylinder housing, the position sensor including a sensor magnet;

a sensor element interactable with the sensor magnet, the sensor magnet being:

fastened to and rotatable with respect to the cylinder rod; and guidable in a rotationally fixed manner with respect to the cylinder housing; and an adapter fastened to the sensor magnet, the adapter being:

free of magnetized material on a side facing away from the sensor element; and fastened to the cylinder rod non-displaceably in at least one direction with respect to the longitudinal direction of the cylinder rod, wherein:

the cylinder rod has a stop for the adapter;

the piston comprises a spring fastened in a rotationally secured manner relative to the cylinder housing and configured to prestress the adapter against the stop; and the adapter is fastened to the spring in a rotationally secured manner such that the adapter is rotationally secured relative to the cylinder housing.

9. The cylinder according to claim 8, wherein the adapter is configured to be guided in a guide sleeve in a rotationally secured manner about the cylinder-rod longitudinal axis.

10. The cylinder according to claim 8, wherein the spring is a helical spring.

11. The cylinder according to claim 8, wherein the sensor magnet extends exclusively over a portion of a cylinder-rod circumferential angle of the cylinder rod.

12. The cylinder according to claim 11, wherein the sensor magnet extends over less than a third of the cylinder-rod circumferential angle of the cylinder rod.

13. The cylinder according to claim 11, wherein the sensor magnet is circular segment-shaped.

14. The cylinder according to claim 11, wherein the sensor magnet extends over less than one fifth of the cylinder-rod circumferential angle of the cylinder rod.

15. A gear actuator for a gearbox, comprising the cylinder according to claim 8, the cylinder being configured to shift a gate, and the cylinder rod being coupled to a gate rod of the gearbox.

16. A gearbox having the gear actuator according to claim 15.

* * * * *